US011404803B2

(12) United States Patent
Malpiedi et al.

(10) Patent No.: US 11,404,803 B2
(45) Date of Patent: Aug. 2, 2022

(54) ELECTRICAL CONNECTOR HAVING A STAGGERED CONTACT CARRIER

(71) Applicant: Dresser-Rand Company, Houston, TX (US)

(72) Inventors: Justin Malpiedi, Allegany, NY (US); Christopher Scott, Cuba, NY (US); Steven Rockwood, Allegany, NY (US)

(73) Assignee: Dresser-Rand Company, Houston, TX (US)

( * ) Notice: Subject to any disclaimer, the term of this patent is extended or adjusted under 35 U.S.C. 154(b) by 0 days.

(21) Appl. No.: 17/051,465

(22) PCT Filed: May 17, 2018

(86) PCT No.: PCT/US2018/033239
§ 371 (c)(1),
(2) Date: Oct. 29, 2020

(87) PCT Pub. No.: WO2019/221740
PCT Pub. Date: Nov. 21, 2019

(65) Prior Publication Data

US 2021/0242613 A1 Aug. 5, 2021

(51) Int. Cl.
*H01R 9/24* (2006.01)
*H01R 13/405* (2006.01)
(Continued)

(52) U.S. Cl.
CPC ..... *H01R 9/2491* (2013.01); *H01R 13/405* (2013.01); *H01R 13/5045* (2013.01);
(Continued)

(58) Field of Classification Search
CPC .. H01R 13/502; H01R 13/506; H01R 13/424; H01R 13/436; H01R 13/514;
(Continued)

(56) References Cited

U.S. PATENT DOCUMENTS 5,197,903 A 3/1993 Casey et al.
7,824,233 B2 * 11/2010 Thelen ..... H01R 9/03 439/695
(Continued)

FOREIGN PATENT DOCUMENTS

CN 102576944 A 7/2012
CN 203826578 U 9/2014
(Continued)

OTHER PUBLICATIONS

English Translation of DE 202007005073U1 (Year: 2007).*
(Continued)

*Primary Examiner* — Renee S Luebke
*Assistant Examiner* — Matthew T Dzierzynski

(57) ABSTRACT

An electrical connector for making electrical contact with at least one lead of an electronic device. The connector includes a mounting flange portion and a connector housing portion. The connector also includes at least one conductor having a pin end and a terminal end, wherein the terminal end includes a lead opening that receives the lead and a fastener hole oriented substantially transverse to the lead opening. A fastening element is used to engage the fastener hole and contacts the lead to form electrical contact between the conductor and the lead. The connector further includes a conductor carrier that extends through the connector housing and mounting flange. The conductor carrier includes a base portion and at least one extended portion that extends from the base portion to form a staggered arrangement. The base and extended portions each include a plurality of channels wherein each channel includes a conductor.

17 Claims, 5 Drawing Sheets

(51) Int. Cl.

| | |
|---|---|
| ***H01R 13/504*** | (2006.01) |
| ***H01R 43/00*** | (2006.01) |
| ***H01R 4/36*** | (2006.01) |
| ***H01R 13/74*** | (2006.01) |

(52) U.S. Cl.
CPC ..... *H01R 43/00* (2013.01); *H01R 4/36* (2013.01); *H01R 13/74* (2013.01)

(58) Field of Classification Search
CPC ..... H01R 13/5219; H01R 13/65912; H01R 13/748; H01R 2107/00; H01R 9/03; H01R 13/405; H01R 13/42; H01R 13/426; H01R 13/5045; H01R 13/622; H01R 13/639; H01R 13/6453; H01R 2201/26; H01R 4/30; H01R 4/36; H01R 9/2491
See application file for complete search history.

(56) References Cited

U.S. PATENT DOCUMENTS

| | | | | |
|---|---|---|---|---|
| 7,901,238 | B1 | 3/2011 | Muir et al. | |
| 8,591,268 | B2 * | 11/2013 | Reimchen | H01R 9/03 439/701 |
| 9,209,565 | B2 * | 12/2015 | Michel | H01R 13/508 |
| 9,819,112 | B2 * | 11/2017 | Koester | H01R 13/424 |
| 9,954,305 | B2 * | 4/2018 | Yu | H01R 13/514 |
| 10,305,230 | B2 * | 5/2019 | AbuGhazaleh | H01R 13/6683 |
| 10,389,056 | B2 * | 8/2019 | Suzuki | H01R 13/447 |
| 2005/0112953 | A1 * | 5/2005 | Ratchford | H01R 13/436 439/695 |
| 2005/0227545 | A1 * | 10/2005 | Lahoreau | H01R 13/65912 439/695 |
| 2005/0233639 | A1 * | 10/2005 | Blosch | H01R 13/44 439/587 |

FOREIGN PATENT DOCUMENTS

| | | | |
|---|---|---|---|
| CN | 104332756 | A | 2/2015 |
| CN | 104882751 | A | 9/2015 |
| CN | 106025661 | A | 10/2016 |
| DE | 202007005073 | U1 * | 6/2007 |
| DE | 102016104082 | B3 | 2/2017 |

OTHER PUBLICATIONS

PCT International Search Report and Written Opinion dated Feb. 11, 2019 corresponding to PCT Application No. PCT/US2018/033239 filed May 17, 2018.

Milnec Interconnect Systems catalogue, EV Series MIL-DTL-83723 Series III Military Style Connectors, 2013, Milnec Interconnect Systems LLC, Downingtown, PA.

Amphenol® MIL-DTL-5015 and MIL-5015 Type Standard Cylindrical Connectors catalogue 12-020-18, Amphenol Corporation, Amphenol Industrial Operations, Sidney, NY.

* cited by examiner

ELECTRICAL CONNECTOR HAVING A STAGGERED CONTACT CARRIER

BACKGROUND

1. Technical Field

Aspects of the invention relate to an electrical connector, and more particularly, to an electrical connector having at least one conductor that includes a pin end and a terminal end, wherein the terminal end includes a lead opening that receives a lead and a fastener hole oriented substantially transverse to the lead opening wherein the at least one conductor is held in a conductor carrier having a base portion and at least one extended portion that extends from the base portion to form a staggered arrangement wherein the base and extended portions each include a plurality of channels wherein each channel includes a conductor.

2. Description of Related Art

Rotating and reciprocating turbomachinery typically include electronic instrumentation that monitors machine safety and performance. The instrumentation is typically mounted on and/or inside the machine and requires connections and/or terminations that are routed to an overall machine monitoring system. Installation and routing of the connections and/or terminations is complicated and difficult due to the limited amount of space available inside the machine. Further, the apparatus used for mounting the instrumentation may hinder general maintenance and service to the machinery. It is desirable to provide additional space access to the machines and minimize the labor and effort needed to install and maintain machinery.

SUMMARY

An electrical connector is disclosed for making electrical contact with at least one lead of an electronic device. The connector includes a mounting flange portion and a connector housing portion that extends along a center axis from the mounting flange portion. The connector also includes at least one conductor having a pin end and a terminal end, wherein the terminal end includes a lead opening that receives the lead and a fastener hole oriented substantially transverse to the lead opening. In addition, the connector includes a fastening element that engages the fastener hole and contacts the lead to form electrical contact between the conductor and the lead. Further, the connector includes a conductor carrier that extends through the connector housing and mounting flange, the conductor carrier having a base portion and at least one extended portion that extends from the base portion to form a staggered arrangement. In particular, the base and extended portions each include a plurality of channels wherein each channel includes a conductor.

In addition, a method of attaching a lead from an electronic device to a connector disclosed. The method includes providing a connector housing portion that extends along a center axis. The method also includes providing at least one conductor having a pin end and a terminal end, wherein the terminal end includes a lead opening that receives the lead and a fastener hole oriented substantially transverse to the lead opening. The lead is inserted into the lead opening and the fastening element is engaged with the fastener hole and contacts the lead to form electrical contact between the conductor and the lead. In addition, the method includes providing a conductor carrier that extends through the connector housing, the conductor carrier having a base portion and at least one extended portion that extends from the base portion to form a staggered arrangement. Further, the base and extended portions each include a plurality of channels wherein each channel includes a conductor.

Those skilled in the art may apply the respective features of the present invention jointly or severally in any combination or sub-combination.

BRIEF DESCRIPTION OF DRAWINGS

The exemplary embodiments of the invention are further described in the following detailed description in conjunction with the accompanying drawings, in which.

To facilitate understanding, identical reference numerals have been used, where possible, to designate identical elements that are common to the figures. The figures are not drawn to scale.

DETAILED DESCRIPTION

Figure 1A:
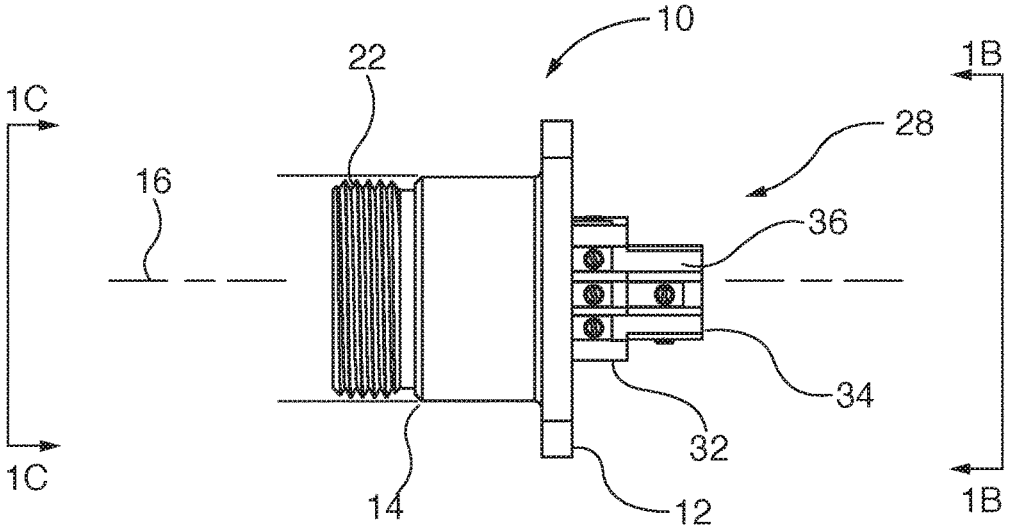
FIG. 1A is a side view of a receptacle electrical connector in accordance with an aspect of the present invention.

Although various embodiments that incorporate the teachings of the present disclosure have been shown and described in detail herein, those skilled in the art can readily devise many other varied embodiments that still incorporate these teachings. The scope of the disclosure is not limited in its application to the exemplary embodiment details of construction and the arrangement of components set forth in the description or illustrated in the drawings. The disclosure encompasses other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1B:
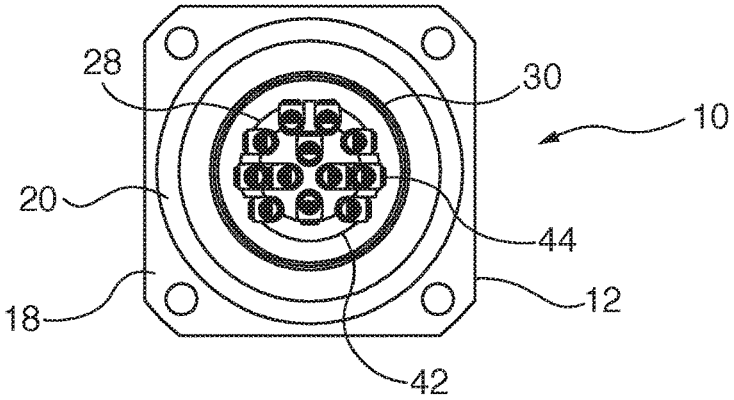
FIG. 1B is a rear view of the receptacle connector along view lines 1B-1B of FIG. 1A.
Figure 1C:
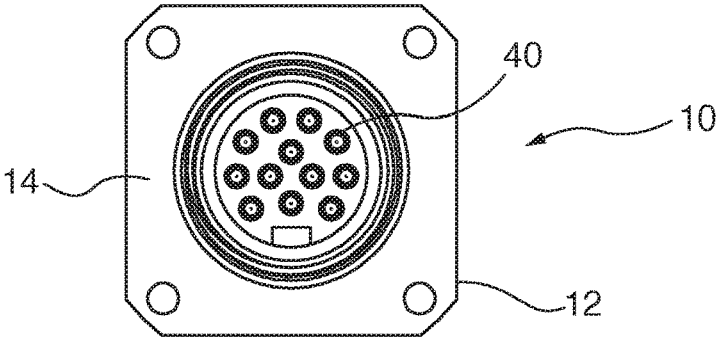
FIG. 1C is a front view of the receptacle connector along view line 1C-1C of FIG. 1A.
Figure 2:
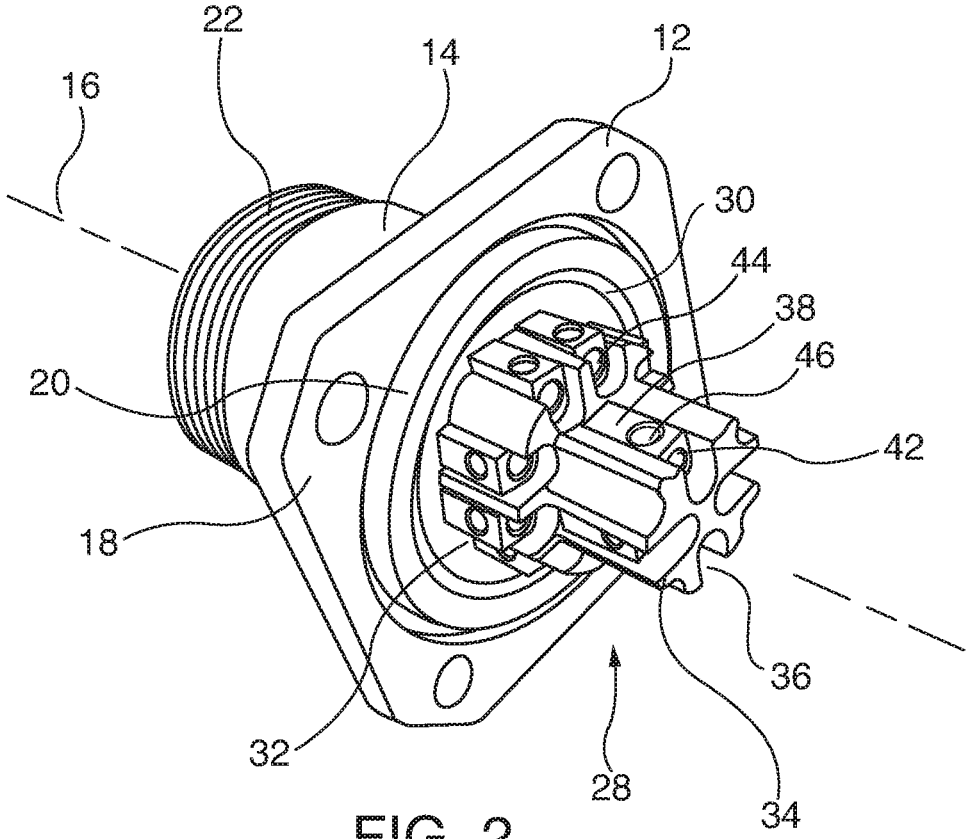
FIG. 2 is a rear perspective view of the receptacle connector.
Figure 3:
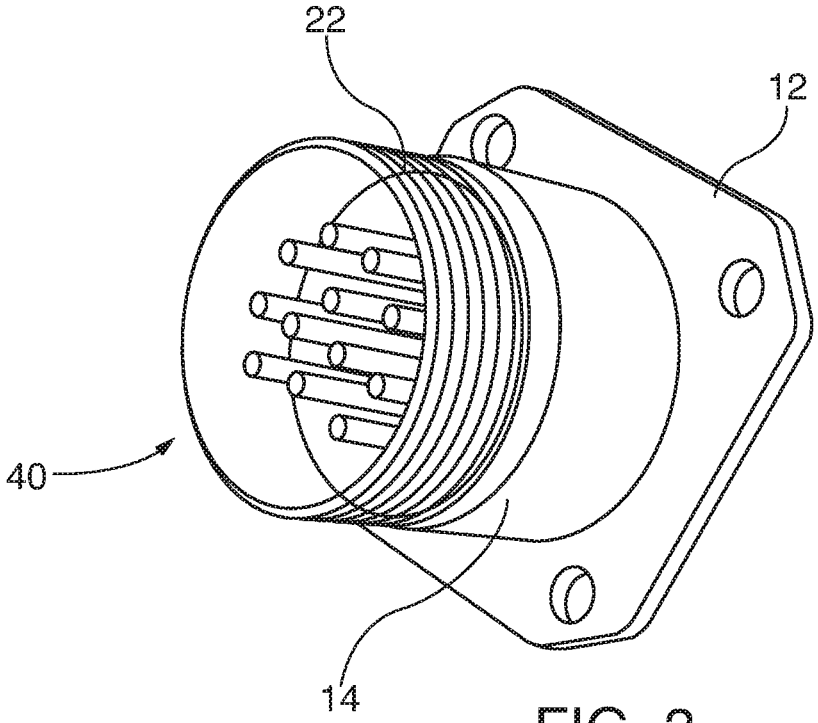
FIG. 3 is a front perspective view of the receptacle connector.

Referring to FIG. 1A, a side view of a receptacle electrical connector 10 in accordance with an aspect of the present invention are shown. FIGS. 1B and 1C are rear and front views of the receptacle connector 10 along view lines 1B-1B and 1C-1C, respectively, of FIG. 1A. The receptacle connector 10 includes a mounting flange portion 12 and a connector housing portion 14 that extends along a center axis 16 from the mounting flange portion 12. The connector housing 14 is substantially round in shape and a size of the mounting flange 12 in a direction orthogonal to the center axis 16 is larger than a diameter of the connector housing 14. In addition, the mounting flange 12 includes a mounting surface 18 having a sealing element 20 such as an O-ring (see FIGS. 1B and 2). The connector housing 14 also includes external threads 22 which threadably engage with internal threads 24 of a mating cordset female connector 26 (see FIG. 6) as will be described. FIGS. 2 and 3 are rear and front perspective views, respectively, of the receptacle connector 10. Referring to FIGS. 1A-1C, 2 and 3, the receptacle connector 10 also includes a contact or conductor carrier 28 that extends through a connector hole 30 formed in the connector housing 14 and mounting flange 12. The carrier 28 includes a base portion 32 that includes a plurality of channels 36. In another embodiment of the carrier 28, at least one extended portion 34 extends from the base portion 32 to form a staggered arrangement for the carrier 28. The base 32 and extended 34 portions each include a plurality of channels 36. In an embodiment, each channel 36 includes an opening to form a substantially U-shaped channel 36. That is, each channel 36 defines a respective unwalled open portion of the conductor carrier extending along a longitudinal axis of each respective channel 36, as shown in FIG. 2. Each channel 36 receives a conductor 38 to provide a receptacle connector 10 having a plurality of pins 40 (see FIGS. 3 and 1C) and a corresponding plurality of terminal ends 42 (see FIGS. 1B and 2). Each pin 40 is adapted to be inserted into the female connector 26.

Figure 4:
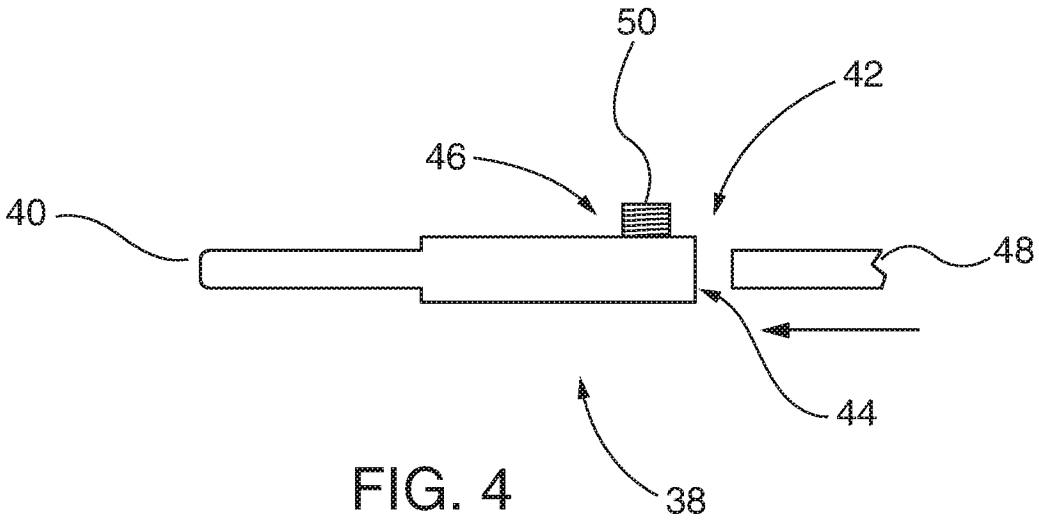
FIG. 4 is a side view of an electrical conductor in accordance with an aspect of the present invention.

FIG. 4 is a side view of the electrical conductor 38. The conductor 38 includes a male pin end or pin 40 and a terminal end 42. The pin 40 and terminal end 42 may be unistructurally or integrally formed as one piece. Each terminal end 42 includes a lead opening 44 (see FIGS. 1B and 2) oriented substantially parallel to the center axis 16 and a fastener hole 46 oriented transverse to the orientation of the lead opening 44. In an embodiment, the fastener hole 46 is threaded. The carrier 28 may be fabricated from a thermoplastic material. In an embodiment, each conductor 38 is integrally molded within its respective channel 36 to hold the conductor 38 within the carrier 28. An adhesive such as an epoxy may be also be used to attach the conductor 38 to the carrier 28. The carrier 28 and connector hole 30 are both sized such that an interference fit is formed between the carrier 28 and the connector hole 30 to thus attach the carrier 28 to the receptacle connector 10. An adhesive such as an epoxy may also be used to attach the carrier 28 to the receptacle connector 10.

The lead opening 44 is configured to receive a wire or lead 48 that extends from an electronic device. Upon insertion of the lead 48 into the lead opening 44, a fastener element 50, such as a threaded fastener, is engaged with the fastener hole 46 until it contacts the lead 48. The fastener element 50 then pushes against the lead 48 such that the lead 48 in turn contacts an interior wall of the terminal end 42 to form electrical contact with the conductor 38. In an embodiment, the base portion 32 includes eight conductors 38 and the extended portion 34 includes four conductors 38 to enable the attachment of twelve leads 48 to the carrier 28. Alternatively, the carrier 28 includes a single channel 36 that receives a conductor 38.

Figure 5:
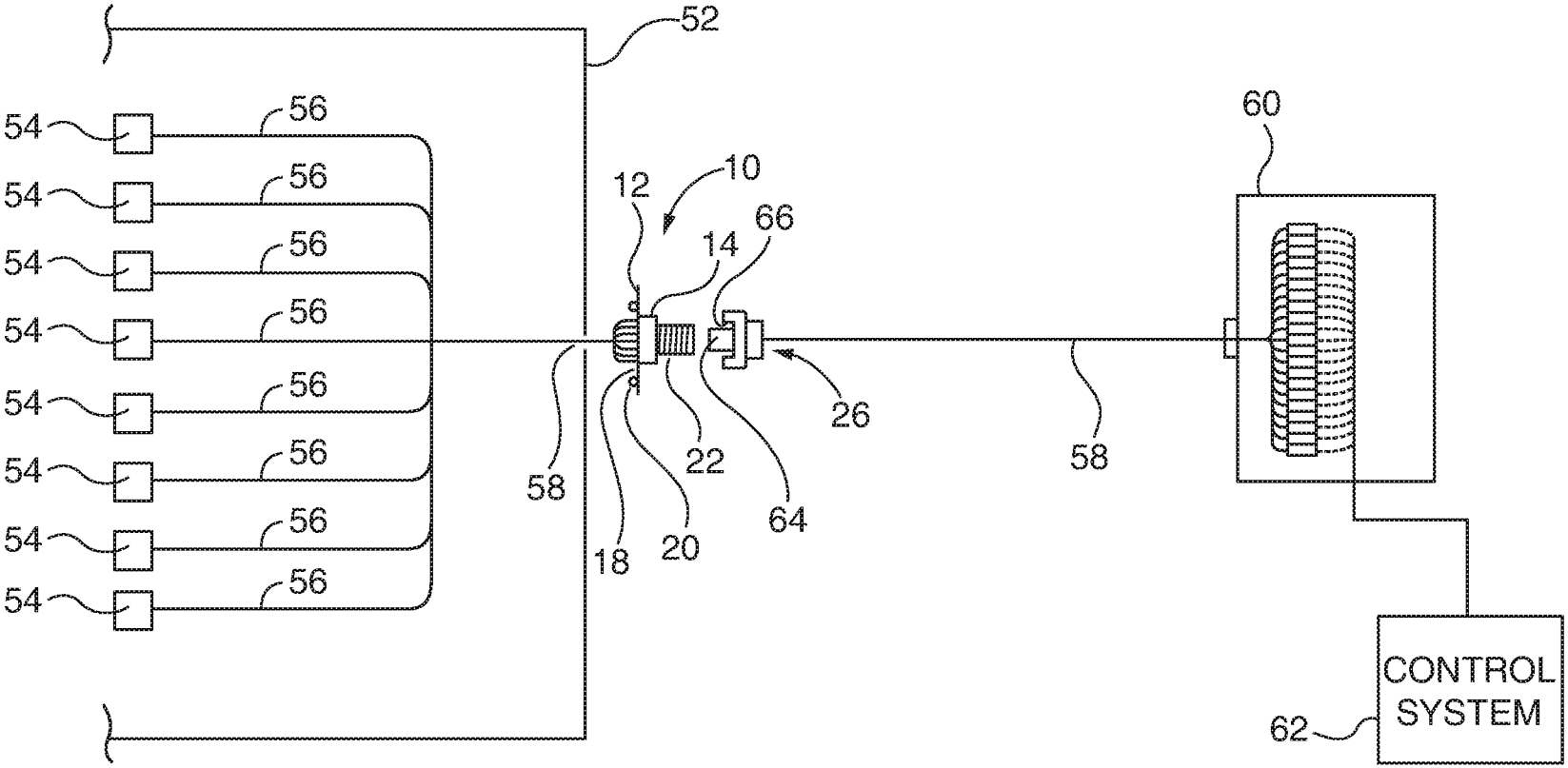
FIG. 5 depicts a wiring arrangement in accordance with an aspect of the invention.
Figure 6:
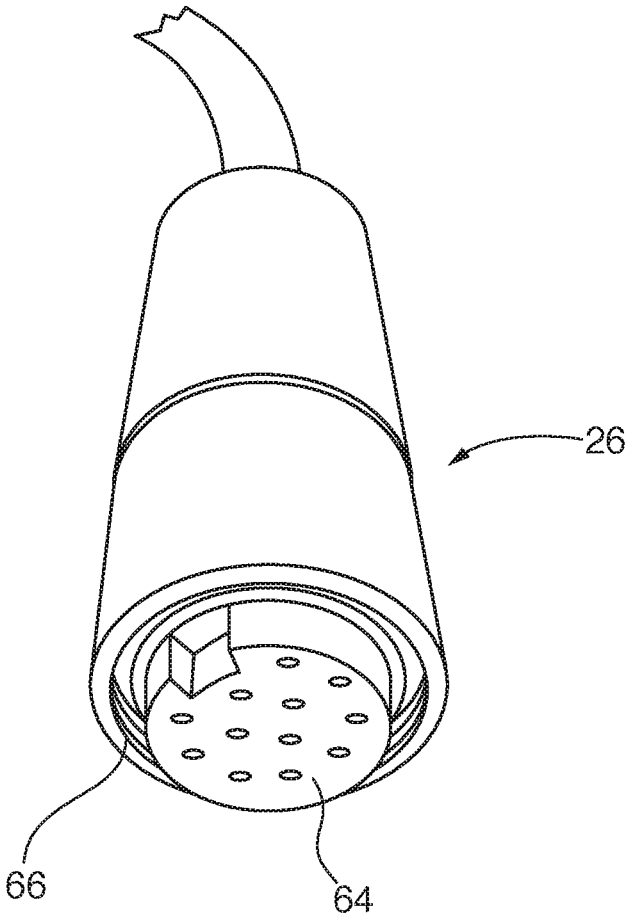
FIG. 6 is an end view of a female connector.

The receptacle connector 10 may be used as an electrical termination device that enables electronic instrumentation or devices used in connection with rotating and reciprocating turbomachinery to be readily connected or disconnected locally. Referring to FIG. 5, a wiring arrangement in accordance with an aspect of the invention is shown. The mounting surface 18 of the mounting flange 12 is attached to a machinery housing 52 of a turbomachine. The sealing element 20 is located between the mounting surface 18 and the machinery housing 52 thus sealing the mounting flange 12 from the machinery housing 52. A plurality of electronic devices 54, such as sensors, may be located within the machinery housing 52. Each device 54 includes a lead 56 that is routed from within the machinery housing 52 to a housing opening 58 that forms an exit point on the turbomachine for the leads 56. Each lead 56 is then attached to a respective terminal end 42 of the receptacle connector 10, as previously described, to terminate the lead 56. In an embodiment, the turbomachine is a compressor and the sensors are resistance temperature detectors (RTDs) used to monitor various operating parameters of associated compressor bearings used in the compressor. The wiring arrangement includes a cable 58 that extends from a junction box 60 electrically connected to a known control system 62 for the turbomachine. The female connector 26 is attached to an end of the cable 58. Referring to FIG. 6, an end view of the female connector 26 is shown. The female connector 26 includes female pins 64 that receive the male pins 40 and an internal thread 66 that engages the external thread 22 of the receptacle connector 10. Upon engagement of the internal 66 and external 22 threads, the male 40 and female 64 pins are mated to form an electrical circuit between the control system 62 and the devices 54.

It has been found by the inventor herein that the present invention conserves space by a factor of three and requires fewer parts than a conventional connector. Further, the pins of conventional connectors are either crimped or soldered and thus are substantially permanently affixed to the pins of the connector. If maintenance is needed for the connector, or if one or more leads have to be replaced, the associated pins have to be cut out and the connector has to be rebuilt. The conductors 38 of the present invention enable the replacement of leads without having to cut pins and rebuilding the receptacle connector 10.

The conductors 38 of the invention are integrated into the conductor carrier 28 and thus do not require sealing as with conventional connector pins. The present invention also enables pin sizes that are much larger than that provided by conventional connector designs which results in a connector that is substantially more robust than conventional connectors. In addition, the present invention results in lower material and overhead costs and substantially reduces maintenance and time needed to wire and route machinery instrumentation. Standardized instrument connection details and procedures may also be maintained to support plug and play technologies.

While particular embodiments of the present disclosure have been illustrated and described, it would be obvious to those skilled in the art that various other changes and modifications can be made without departing from the spirit and scope of the disclosure. It is therefore intended to cover in the appended claims all such changes and modifications that are within the scope of this disclosure.

What is claimed is:

1. An electrical connector for making electrical contact with at least one lead of an electronic device, comprising:

a mounting flange portion;

a connector housing portion that extends along a center axis from the mounting flange portion;

at least one conductor having a pin end and a terminal end, wherein the terminal end includes a lead opening that receives the lead and a fastener hole oriented substantially transverse to the lead opening and wherein a fastening element engages the fastener hole and contacts the lead to form electrical contact between the conductor and the lead; and a conductor carrier extending through the connector housing and mounting flange, the conductor carrier having a base portion and at least one extended portion that extends from the base portion to form an axially staggered arrangement wherein the base and extended portions of the conductor carrier each includes a plurality of channels, wherein each respective channel is U-shaped and defines a respective unwalled open portion of the conductor carrier extending along a longitudinal axis of each respective channel, wherein each respective channel includes a respective conductor of said at least one conductor, and wherein the fastener hole of the respective conductor faces the respective unwalled open portion of the conductor carrier to permit insertion of the fastening element into the fastener hole through the unwalled open portion of the conductor carrier.

2. The connector according to claim 1, wherein the pin and terminal ends of the conductor are unistructurally formed.

3. The connector according to claim 1, wherein each conductor is integrally molded within the channel.

4. The connector according to claim 1, wherein the conductor carrier is held within the connector housing and mounting flange by an interference fit.

5. The connector according to claim 1, wherein the lead opening is oriented substantially parallel to the center axis.

6. The connector according to claim 1, wherein the mounting flange includes a sealing element.

7. An electrical connector for making electrical contact with at least one lead of an electronic device, comprising:

a mounting flange portion;

a connector housing portion that extends along a center axis from the mounting flange portion, wherein a connector hole extends through the connector housing and mounting flange portions;

at least one conductor having a pin end and a terminal end, wherein the terminal end includes a lead opening that receives the lead and a fastener hole oriented substantially transverse to the lead opening and wherein a fastening element engages the fastener hole and contacts the lead to form electrical contact between the conductor and the lead; and a conductor carrier extending through the connector hole, wherein the conductor carrier is held within the connector housing and mounting flange by an interference fit and wherein the conductor carrier includes a base portion and at least one extended portion that extends from the base portion to form an axially staggered arrangement wherein the base and extended portions of the conductor carrier each includes a plurality of channels, wherein each respective channel is U-shaped and defines a respective unwalled open portion of the conductor carrier extending along a longitudinal axis of each respective channel, wherein each respective channel includes a respective conductor of said at least one conductor, and wherein the fastener hole of the respective conductor faces the respective unwalled open portion of the conductor carrier to permit insertion of the fastening element into the fastener hole through the unwalled open portion of the conductor carrier.

8. The connector according to claim 7, wherein the pin and terminal ends of the conductor are unistructurally formed.

9. The connector according to claim 8, wherein each conductor is integrally molded within the channel.

10. The connector according to claim 7, wherein the lead opening is oriented substantially parallel to the center axis.

11. The connector according to claim 7, wherein the mounting flange includes a sealing element.

12. A method of attaching a lead from an electronic device to a connector, comprising:

providing a connector housing portion that extends along a center axis;

providing at least one conductor having a pin end and a terminal end, wherein the terminal end includes a lead opening that receives the lead and a fastener hole oriented substantially transverse to the lead opening;

inserting the lead into the lead opening;

inserting a fastening element into the fastener hole and engages the lead to form electrical contact between the conductor and the lead; and providing a conductor carrier that extends through the connector housing, the conductor carrier having a base portion and at least one extended portion that extends from the base portion to form a staggered arrangement wherein the base and extended portions each includes a plurality of channels, wherein each respective channel is U-shaped and defines a respective unwalled open portion of the conductor carrier extending along a longitudinal axis of each respective channel, wherein each respective channel includes a respective conductor of said at least one conductor, wherein the fastener hole of the respective conductor faces the respective unwalled open portion of the conductor carrier; and wherein the inserting of the fastening element into the fastener hole is performed through the unwalled open portion of the conductor carrier.

13. The method according to claim 12, wherein the pin and terminal ends of the conductor are unistructurally formed.

14. The method according to claim 12, wherein each conductor is integrally molded within the channel.

15. The method according to claim 12, wherein the conductor carrier is held within the connector housing by an interference fit.

16. The method according to claim 12, wherein the lead opening is oriented substantially parallel to the center axis.

17. The method according to claim 12, wherein the electronic device is a resistance temperature detector.

* * * * *